United States Patent [19]

Poston

[11] 4,327,805

[45] May 4, 1982

[54] METHOD FOR PRODUCING VISCOUS HYDROCARBONS

[75] Inventor: Robert S. Poston, Winter Park, Fla.

[73] Assignee: Carmel Energy, Inc., Houston, Tex.

[21] Appl. No.: 76,587

[22] Filed: Sep. 18, 1979

[51] Int. Cl.[3] ..... E21B 43/24

[52] U.S. Cl. ..... 166/272; 166/303

[58] Field of Search ..... 166/268, 272, 303, 305 R, 166/263; 175/263, 267

[56] References Cited

U.S. PATENT DOCUMENTS

| | | | |
|---|---|---|---|
| Re. 24,873 | 9/1960 | Lindauer, Jr. | 166/268 |
| 1,467,480 | 9/1923 | Hogue | 175/263 |
| 1,739,206 | 12/1929 | Buchanan | 175/267 X |
| 1,868,702 | 7/1932 | Granville | 175/267 X |
| 2,353,652 | 7/1944 | Coonrod | 166/314 X |
| 3,358,759 | 12/1967 | Parker | 166/263 |
| 3,455,392 | 7/1969 | Prats | 166/303 |
| 3,542,131 | 11/1970 | Walton et al. | 166/303 X |
| 3,814,186 | 6/1974 | Allen | 166/272 |
| 3,838,738 | 10/1974 | Redford | 166/272 X |
| 3,948,323 | 4/1976 | Sperry et al. | 166/303 |
| 3,983,939 | 10/1976 | Brown et al. | 166/272 X |
| 3,987,853 | 10/1976 | Allen | 166/272 |
| 3,993,135 | 11/1976 | Sperry et al. | 166/303 |

OTHER PUBLICATIONS

Bleakley, W. B., *The Oil and Gas Journal,* Nov. 13, 1967, pp. 132–134.

*Primary Examiner*—Stephen J. Novosad
*Assistant Examiner*—George A. Suchfield
*Attorney, Agent, or Firm*—Pravel, Gambrell, Hewitt, Kirk, Kimball & Dodge

[57] ABSTRACT

A method for recovering viscous hydrocarbons and synthetic fuels from a subterranean formation by drilling a well bore through the formation and completing the well by cementing a casing means in the upper part of the pay zone. The well is completed as an open hole completion and a superheated thermal vapor stream comprised of steam and combustion gases is injected into the lower part of the pay zone. The combustion gases migrate to the top of the pay zone and form a gas cap which provides formation pressure to produce the viscous hydrocarbons and synthetic fuels.

10 Claims, 3 Drawing Figures

METHOD FOR PRODUCING VISCOUS HYDROCARBONS

The government of the United States of America has rights in this invention pursuant to Contract No. ET-78-C-03-2046, awarded by the U.S. Energy Research and Development Administration (not Department of Energy).

TECHNICAL FIELD OF THE INVENTION

The present invention relates to a method of producing highly viscous hydrocarbons, particularly crude oil, and synthetic fuels, from subterranean formations. More particularly, the invention involves the completion of a well in the bottom portion of the pay zone of a hydrocarbon containing formation and the injection of a non-condensable gas-containing thermal vapor stream into the pay zone such that non-condensable gas is retained in the upper part of the pay zone during production.

PRIOR ART

The prior art is replete with various methods devised to produce highly viscous hydrocarbons from underground formations. Most of these methods involve the injection of steam or a hot fluid into the formation to reduce viscosity of the hydrocarbons and to increase formation pressure.

In situ combustion is a very popular method of providing heat to the formation to reduce viscosity. This method, however, involves several major operating disadvantages, and in many cases, fails to adequately and economically produce crude oil. In situ combustion methods, such as described in U.S. Pat. Nos. 3,409,083; 3,369,604; 4,127,171; 4,133,384; and 4,133,382, for example, invariably involve the injection of an oxygen-rich gas, which can be quite costly, to support combustion. A second disadvantage is that these processes consume a large quantity of the hydrocarbons which they are designed to produce.

Large reserves of highly viscous crude oil, 21° API and heavier, are known to exist in the Cherokee sandstones of southwestern Missouri. Several major and independent oil companies have tried to produce these reserves of several hundred million barrles of oil using different techniques of steam drive and in situ combustion, including some of those mentioned above. All efforst failed to economically produce the viscous crude.

The method of U.S. Pat. No. 3,948,323, provides for the injection of a heated fluid comprised of steam and a heated non-condensable gas. Even this normally succesful injection process failed to successfully produce the viscous oil trapped in the Cherokee sandstones of Missouri to the extent possible when used in conjunction with the method of this invention.

SUMMARY OF THE INVENTION

The present invention provides a method for recovering highly viscous minerals and synthetic fuels from subterranean formations which have been previously believed to be unproducible. It has been discovered that higher production rates and greater overall production of viscous crude can be achieved with a higher utilization of energy by fluid injection into the lower portion of the pay zone to form a gas cap to assist in the subsequent production through the lower portion of the pay zone. The invention has several different, but related, embodiments and is suitable for use in drive-type fields composed of multiple injection and production wells as well as formations penetrated by a single injection and production well. Synthetic fuel includes fuel sources, such as, tar sands, shale oil and other fossil fuels which do not migrate under their own volition.

The invention comprises the steps of drilling a well bore and completing the well usually by setting and cementing a well casing in the lower portion of a pay zone in the formation. The bottom portion of the pay zone is then drilled out, leaving an open hole completion, into which a thermal vapor stream, comprised of steam and combustion gases created by burning a hydrocarbon fuel with a substantially stoichiometric quantity of air, is injected to first heat the formation and the viscous hydrocarbons contained therein.

The injected gas migrates to the top of the mineral bearing formation and forms a gas cap which is prevented from escaping through the well bore by the well casing. After sufficient gas has been injected, the well is put into production with the gas cap providing additional energy and pressure to move the heated viscous minerals to the well bore. Alternatively, the casing can be set and cemented throughout the pay zone and perforated only in the lower part of the pay zone. If the well were completed throughout the entire pay zone or at the top of the pay zone, as is the normal practice, no gas cap would be formed and the non-condensable gases of the thermal vapor stream would migrate across the top of the reservoir to the well bore very quickly, resulting in a much faster decline in reservoir pressure.

In the preferred embodiment, the well bore is completed as close to the bottom of the pay zone as possible in the foundation. For example, completion of the well bore to within about forty-five centimeters of the bottom of the pay zone has been shown to result in the production of substantial quantities of viscous hydrocarbons and synthetic fuels.

At times production is inhibited by low formation permeabilities or heavy petroleum residues. An especially preferred embodiment of this invention which greatly increases the production of viscous hydrocarbons is the enlargement of the bottom portion of the well bore below the cemented casing through the use of a bell bottom bore or an explosive bomb, for example. A well casing is set and cemented into the pay zone at a depth of about one-half to about two-thirds of the depth of the pay zone. And, the bottom portion of the pay zone is drilled out leaving an open hole completion. Then, a bell bottom bore is employed to enlarge the bottom of the well in the pay zone before the injection of the non-condensable gas-containing fluid into the pay zone. Alternatively, and explosive bomb can be utilized to enlarge the bottom of the well in the pay zone instead of a bell bottom bore.

BRIEF DESCRIPTION OF THE DRAWINGS

The instant invention will be better understood by reference to the drawings which illustrate specific embodiments.

DETAILED DESCRIPTION

Figure 1:
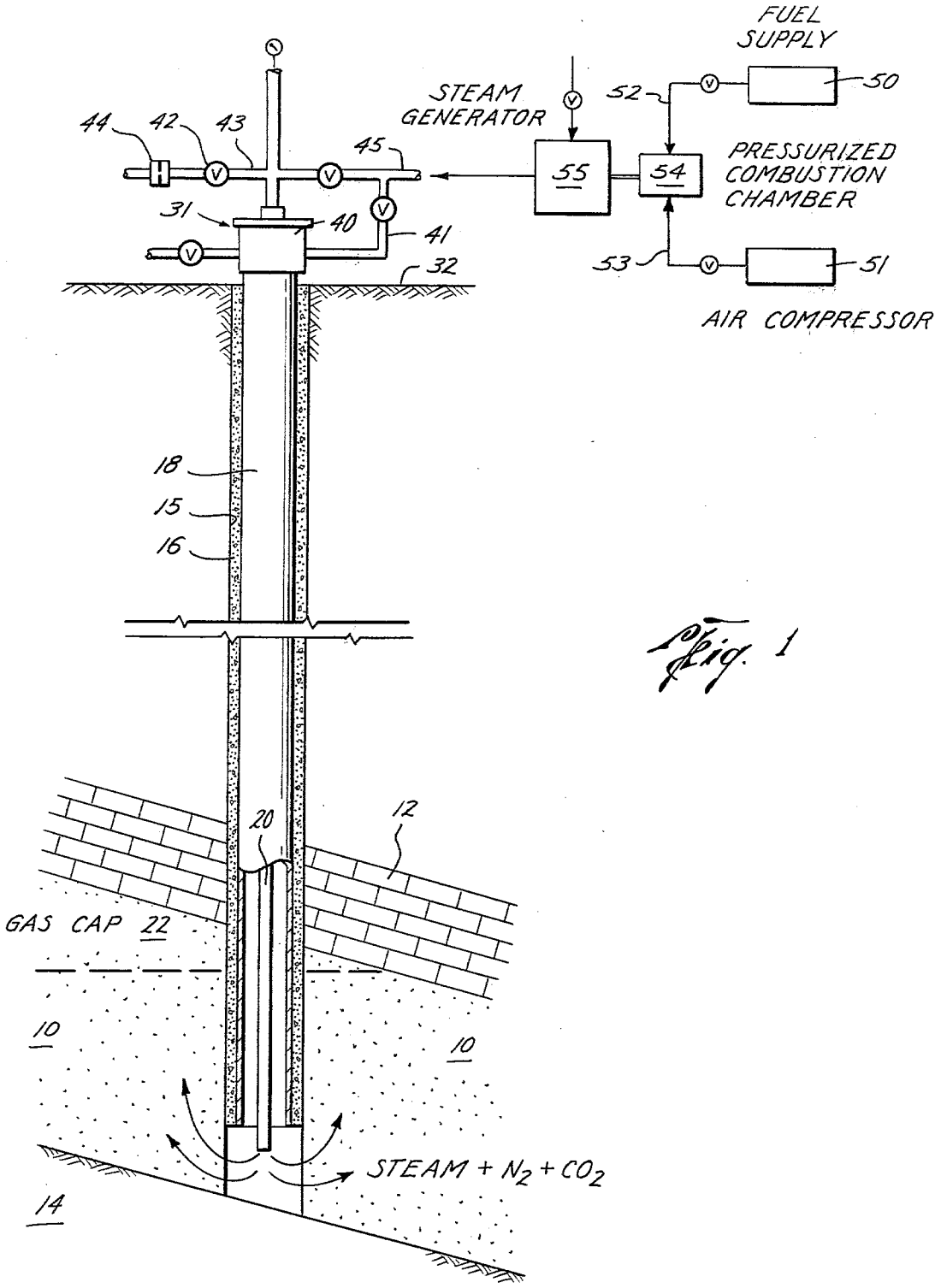
FIG. 1 is an elevation view, in section, of the broad application of the invention showing the well completion in the lower one-half of the pay zone with an open hole completion.

The method of the instant invention allows the production of heretofore unavailable mineral reserves, particularly heavy crude oil and synthetic fuels. Extraordinary production results have been achieved from reservoirs containing viscous crude having a specific gravity of 21° API or heavier from formations with very little bottom hole pressure.

The method offers several advantages over present recovery techniques for highly viscous minerals in addition to increased recoveries. First, in situ combustion, which results in the loss of much of the hydrocarbons being recovered through combustion, is not needed. Second, the method can be used in combination with practically any other method for producing viscous minerals or for increasing recovery through secondary or tertiary efforts, such as those methods cited in the prior art.

Besides its principal use with a combination injection and production well, the invention is also suitable for use in drive-type fields composed of multiple injection and production wells. In applying the method of the invention in a drive-type field, at least the well or wells through which the heated viscous oil passes, known as the production wells, must be completed in the lower portion of the pay zone so that maximum advantage of the gas cap can be achieved. Usually the well or wells through which the combustion gases and steam are injected into the formation, known as the injection well or wells, will also be completed in a like manner in the lower portion of the formation. Injection of the thermal vapor stream through the injection well or wells may be continuous or intermittent, unlike the practice of this invention in a formation penetrated by a single injection and production well. The hot gases and steam injected into the formation lowers the viscosity of the heavy, viscous oil allowing it to flow toward the production well or wells and be recovered at the surface after passage through these wells.

The flexibility of this invention and its ability to be used with many recovery methods is perhaps its greatest advantage. But most importantly, the hydrocarbon recovery efficiency is roughly twice of that of a steam drive in a two well system in approximately two-thirds of the time. Thus, increased production rates and more effective reservoir exploitation are achieved.

The invention comprises the steps of drilling a well bore, and completing the well, usually by setting and cementing a well casing means into the bottom portion of the pay zone of the formation. The bottom or lower portion of the pay zone is defined to include the lower half of the pay zone. In a preferred embodiment, the well is completed with the setting and cementing of the casing within about forty-five centimeters of the bottom of the pay zone. The bottom portion of the pay zone is then drilled out leaving an open hole completion communicating with the oil-bearing formation. Hot gases, such as steam, containing a non-condensable gas, such as nitrogen, carbon dioxide, or mixtures of non-condensable gases are injected into the pay zone to heat the formation.

The hot gases most preferably used are normally comprised of a mixture of combustion gases from burning a hydrocarbon fuel in the presence of an oxygen-containing gas, preferably air, and steam to produce a thermal vapor stream. This thermal vapor stream can be easily produced by a combination combustion chamber and steam generator, like that disclosed in U.S. Pat. No. 4,118,925, such disclosure being incorporated herein by reference for all purposes. A hydrocarbon fuel is burned in the combustion chamber in the presence of a substantially stoichiometric amount of an oxygen-containing gas, preferably air, to produce the combustion gases, most notably water and carbon dioxide, which are then channelled through the steam generator to produce the thermal vapor stream.

U.S. Pat. No. 3,948,323 discloses a method of injecting the above mentioned thermal vapor stream into a hydrocarbon bearing formation to give higher production rates and greater overall production of viscous crude or synthetic fuel, such disclosure being incorporated herein by reference for all purposes. The method of U.S. Pat. No. 3,948,323 has proved highly successful when practiced with the method of the present invention and is a preferred method of practicing this invention.

In the process of said patent, the thermal vapor stream is first injected at a predetermined rate to heat the formation and increase the mobility of the petroleum. Usually the thermal vapor stream is injected at the maximum injection rate possible without exceeding the formation fracture gradient pressure. This is normally within the range of from about 7 to about 105 kilograms per square centimeter pressure, at a temperature within the range of from about 95° to about 400° C., especially about 180° to about 375° C. An initial injected rate of from about 20 million to about 250 million BTUs heat per day is achieved. This, of course, depends upon formation permeability, porosity, percent of petroleum saturation, formation temperature pressure, and the like.

After the initial start-up, the thermal vapor stream injection is discontinued when its injection rate diminishes to a level of from about 1/10 to about ½ its initial injection rate. The injection of the non-condensable gas is then immediately begun to drive any condensed liquids through the formation away from the well bore. This permits the renewed injection of the thermal vapor stream at the desired rate. The thermal vapor stream and heated non-condensable gas are then alternately injected in sequence and the heated, mobile hydrocarbons are withdrawn from the formation.

The method described in U.S. Pat. No. 3,993,135 is particularly preferred for use in conjunction with the practice of this invention. The disclosure of such patent is incorporated herein by reference for all purposes.

Nitrogen and/or carbon dioxide in the injected gases, migrate to the top of the oil bearing pay zone and form a gas cap being contained by the casing means. Some of the carbon dioxide is absorbed underground by the formation water and by the viscous crude oil itself, thereby further reducing the viscosity of the petroleum. The remainder of the carbon dioxide the nitrogen and any other non-condensable gas in creating the gas cap.

The gas cap provides energy and pressure to move the now warmed viscous hydrocarbons and synthetic fuels to the well bore through expansion of the gas cap. The steam and combustion gases additionally provide heat to the formation to lower the viscosity of the heavy crude. Of course, other gases besides the products of hydrocarbon combustion can be utilized to create the gas cap at the top of the pay zone, but they are considerably more costly. Thus the nitrogen, carbon dioxide and other inert gases in the thermal vapor stream serve a dual purpose of imparting heat to the formation and providing pressure in the formation.

The pressure of the gas cap can be increased through further injection of the gas-containing thermal vapor stream. The expansion of the gas cap due to its greater pressure helps to move the heated minerals to the well bore and to force the heated fluids up the casing to the surface. If the viscous minerals are produced at two rapid a rate of production, the gas cap will begin breaking down and the well will start gassing. It has been discovered that this problem can be corrected by ceasing production for a short term. The gassing ceases and the gas cap reforms such that production can be continued without the gassing, thus utilizing the injected heat even further. Artificial lifting and pumping of the hydrocarbons to the surface from the well bore may also be employed to increase recovery.

The fact that the production well is only completed in the bottom portion of the pay zone allows the creation of the gas cap, which enables the vastly increased production of the highly viscous minerals or hydrocarbons. If the well were completed with the entire pay zone open, as has been done in the past, the non-condensable gases forming the gas cap quickly migrate across the top of the reservoir to the well bore resulting in a much faster decline in reservoir pressure and energy. Thus, the present invention gives greater rates of production, higher overall production and better use of energy expended in well stimulation improving the economics and making hitherto unrecoverable hydrocarbons and synthetic fuels economically available.

In a preferred embodiment, the well is completed as close as possible to the bottom of the pay zone. This may involve the completion of the well, with the setting and cementing of casing to within about forty-five centimeters of the bottom of the pay zone.

An especially preferred embodiment is accomplished by the use of a bell bottom bore or explosive bomb to enlarge the bottom of the well bore in the lower portion of the pay zone before injection of the thermal vapor stream. The bell bottom bore becomes particularly useful when minerals are trapped in formations of high density and low permeability. Frequently, the viscosity of the entrapped hydrocarbons will provide so much resistance to flow from the outlying areas of the formation that such a bell bottom bore must be used. Alternatively, an explosive bomb of material, such as 5 to 40 kilograms of DuPont HDP, may be employed to enlarge the bottom of the well in the pay zone instead of the bell bottom bore, or in addition to the bell bottom bore.

An additional embodiment of the present invention involves the setting and cementing of a well casing throughout the pay zone and perforating only the lower portion of the casing adjacent to the pay zone. The completion of the well in the lower portion of the pay zone allows the creation of the gas cap from the injection of the gas-containing fluid. It should be emphasized again that all of the embodiments of the present invention can be easily utilized in combination with practically any method of well stimulation to increase recovery of viscous minerals to achieve much greater recoveries and efficiencies than would be possible without the additional use of the present invention.

Reference to FIG. 1 will illustrate the basic practice of the invention. The well shown generally at 31 has been drilled through the surface of the earch 32. The pay zone of the formation containing the viscous petroleum is indicated by the reference numeral 10. The pay zone 10 is bounded by non-permeable layers of rock 12 and 14. The well bore 15 is completed by cementing the casing means 18 in the upper portion of the pay zone 10 with cement 16. The bottom portion of the pay zone 10 is then drilled out; if not drilled when the well bore 15 was drilled, leaving an open hole completion. An injection tube 20 is placed in the casing 18 to allow for the injection of the thermal vapor mixture of steam and combustion gases into the pay zone 10. The combustion gases migrate to the top of the pay zone 10 and form a gas cap 22 which increases bottom hole pressure enabling production of the viscous minerals after the injection, or warming step, is completed. As usual, of course, each well would have a shutdown valve (not shown).

The mixture of steam and combustion gases may be produced and injected into the pay zone of the formation through the well bore by any process knonw in the art employing any known apparatus. However, as illustrated in the drawing, we prefer to produce the mixture by burning a fluid hydrocarbon fuel, such as diesel oil, fuel oil, propane, butane, natural gas, lease crude, etc., under high pressure in a pressurized combustion chamber 54 in the presence of a high pressure stream of air. The hydrocarbon fuel may be injected into the pressurized combustion chamber 54 through pipe 52 from a suitable fuel supply chamber 50 and the high pressure air stream may be provided by a suitable air compressor 51 connected by proper piping 53. Such pressurized burning forms a pressurized stream of combustion gases which is then transferred to a steam generator 55 by suitable means. The pressurized stream of combustion gases is preferably essentially free of solid carbonaceous particles provided by essentially complete fuel combustion under pressure and has a temperature of approximately 1100°–2200° C. upon leaving the pressurized combustion chamber 54.

Upon entering the steam generator 55 the pressurized combustion gas stream is contacted with water in any conventional manner supplied to the steam generator 55 through suitable piping thereby resulting in the formation of a pressurized thermal vapor stream of steam and combustion gases. This pressurized thermal vapor steam can then be injected into the well 31 through suitable valve-controlled piping 45 and sealing collar 40 connected with the injection tube 20 by means of a valve controlled well injection pipe 45.

A suitable venting means 44 is provided at the surface connected with the surface end of the injection tube 20 by pipe 43 for venting the heated fluid. The venting means 44 includes a means for controlling the pressure in the injection tube, such as a valve, restriction orifice, automatic operating valve or a combination of such devices. This venting means 44 is preferably installed between the end of the pipe 43 and a valve 42. Pipe 41 provides additional venting flexibility from the injection tube 20 by appropriate venting pressure controlling means mounted within pipe 41.

Figure 2:
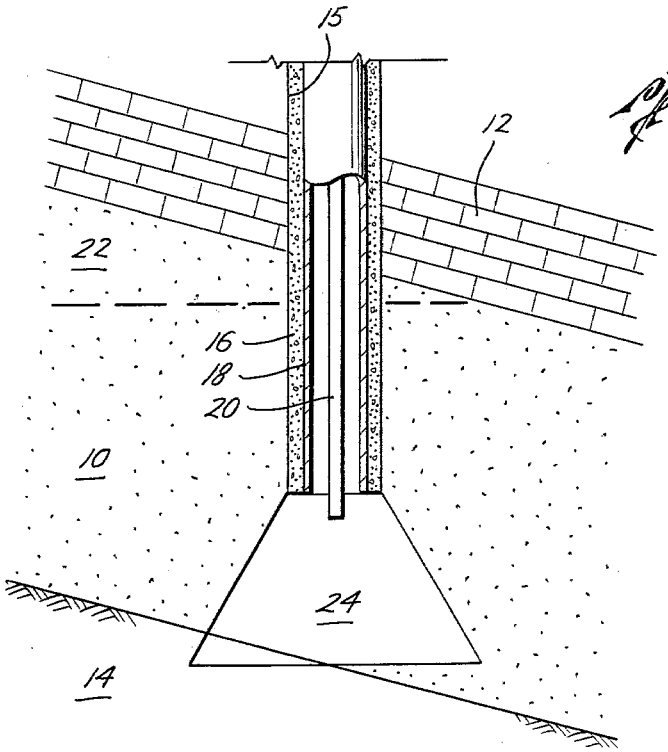
FIG. 2 is an elevation view, in section, illustrating a preferred embodiment of this invention showing a well completion with a bell bottom bore.
Figure 3:
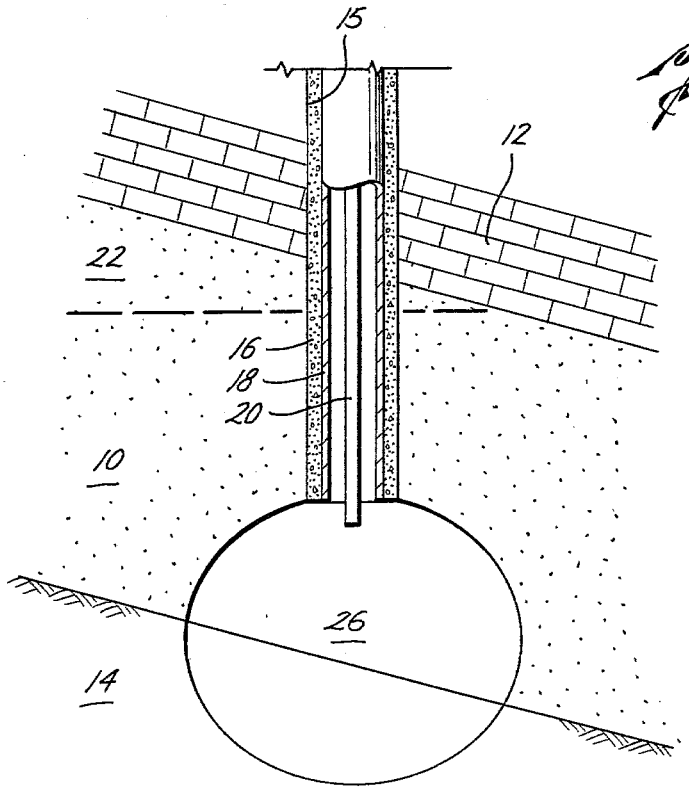
FIG. 3 is an elevation view, in section, illustrating the embodiment wherein the well is completed with an explosive bomb instead of a bell bottom bore to enlarge the lower portion of the pay zone.

FIG. 2 illustrates the well completed with a bell bottom bore. The casing 18 is set in cement 16 in the upper portion of the pay zone 10 bounded by impermeable rock layers 12 and 14. The gas cap 22 provides pressure to drive the heated hydrocarbons into the open cavity 24 created by the bell bottom bore and up the casing to the surface. FIG. 3 is identical to FIG. 2 except that it illustrates a well completed by the use of an explosive bomb instead of a bell bottom bore. The cavity 26 is roughly sperical in shape and some fracturing of the formation may result which further improves the rate of injection of heat into the formation and recovery of the petroleum during the producing step. These enlarged cavities provide for greater efficiency in heating the formation.

Even though useful for broad application such as the production of synthetic fuels, this invention has proven extraordinarily successful in production tests of highly viscous petroleum contained in the Cherokee group of sandstones in southwestern Missouri. These formations contain 100 to 300 million barrels of oil in place at depths of 30 to 100 meters with very little bottom hole pressure. Several major oil companies and independents have previously tried to produce this oil using such stimulation methods as those detailed in the Prior Art section and failed. The specific gravity of the oil in these Cherokee sandstone formation is 21° API and heavier.

The well bore was drilled all the way through the formation containing API 20° viscous crude oil. The well was completed by setting in a casing means through two-thirds of the formation pay zone and cementing in place. Well completion was finished by drilling through the cement and a packer to the bottom of the formation. The well was then injected with a thermal vapor stream comprising superheated steam and combustion gases at about 180°–375° C. and 10–20 kilograms/square centimeter pressure. After heating, the formation injection was ceased and production of the crude was attempted. Insignificant production occurred.

A string shot charge of 29.5 kilograms of DuPont HDP explosive was placed in the bottom of the hole and detonated. The well was then bailed and washed with a 1% by weight aqueous solution of potassium chloride to remove rubble created by the blast. String shot charges were also placed longitudinally in another similar well bore and detonated. But this placement of explosives as distinguished from placement at the bottom of the hole had little effect on production.

Injection of the well with a thermal vapor stream followed in the method described in U.S. Pat. No. 3,993,135 until about 152,000,000 BTUs heat had been carried into the formation. Injection was ceased and production was started. Initial production was 53 barrels of oil per day. In the first 20 days, this well produced 403 barrels of oil which averages to 20 barrels of oil per day. Additional use of explosive charges in the bottom of the well bore further increased the overall production of the Cherokee well. These extraordinary results far exceeded expectations and proved the commercial promise of the present invention. The instant method was employed in combination with the apparatus described in U.S. Pat. No. 4,118,925, which is a combustion chamber and thermal vapor stream producing apparatus, such disclosure being incorporated herein by reference for all purposes. The pressurized combustion gases and steam produced by the above apparatus performed admirably in creating a gas cap in cooperation with the completion method of the instant invention.

Because of the above-explained scope of the invention, many varying and different embodiments may be practiced by those skilled in the art without departing from the breadth of the inventive concept herein taught or the claims appended hereto. Thus, it should be recognized that the use of different gases or a different well completion design to create the gas cap is included within the scope of the inventive concept detailed in this application.

I claim:

1. A method for recovering viscous hydrocarbon crude oil from a subterranean formation having little bottom hole pressure which consists essentially of the steps of:

drilling a well bore to said formation and extending the well bore through the formation;

completing the well bore with a casing means extending to a lower portion of the formation such that the interior of the casing means communicates with the formation in the lower portion of the formation having viscous minerals, including in said completion a tube extending through the casing and into the lower portion of the formation;

injecting into the formation, at elevated pressure, hot gases containing a non-condensable gas to heat the formation to reduce the viscosity of the crude oil and to create a gas cap of non-condensable gas held within an upper portion of the formation by the casing means to increase formation pressure;

ceasing the injection after the formation is heated to allow the heated crude oil, having reduced viscosity, to flow under pressure of the gas cap toward the well bore; and recovering the crude oil from the formation.

2. The method of claim 1, wherein the injection step includes:

initially injecting a thermal vapor stream into the formation at a predetermined rate until the injection rate diminishes to a predetermined level;

discontinuing the injection of the thermal vapor stream;

injecting a heated non-condensable gas into the formation until the injection rate reaches a desired level; and alternately injecting the thermal vapor stream and the heated non-condensable gas into the formation continuously until the formation has been heated to the desired extent.

3. The method of claim 1, wherein the thermal vapor stream is injected into the formation at a temperature of 180° to 375° C. and a pressure of 7 to 105 kilograms per square centimeter.

4. The method of claim 1, where the well bore in the lower portion of the formation is enlarged prior to injection of the thermal vapor stream.

5. A method for recovering heavy viscous hydrocarbon crude oil from a subterranean formation having little bottom hole pressure which consists essentially of the steps of:

drilling multiple well bores to said formation and extending the well bores through the formation;

completing all of the well bores with a casing means extending to a lower portion of the formation such that the interior of the casing means communicates with the formation only in the lower portion of the formation having viscous minerals, including in said completions a tube extending through the casing and into the lower portion of the formation;

injecting into the lower portion of the formation through at least one well bore, said well bore becoming an injection well bore, at elevated pressure, a thermal vapor stream containing non-condensable gas to heat the formation, to reduce the viscosity of the minerals in the formation and to create a gas cap of non-condensable gas held by the casing means within an upper portion of the formation to increase formation pressures to drive the heated crude oil having reduced viscosity towards and into well bores not being used for injection, said well bores being known as producing well bores; and, recovering the crude oil from the formation through the producing well bores.

6. The method of claim 5, wherein the injection of the thermal vapor stream into the formation is discontinued after the formation is heated sufficiently to allow the heated crude oil having reduced viscosity to flow under the pressure of the gas cap towards the producing well bores.

7. The method of claim 5, wherein multiple injection wells are employed to inject the thermal vapor stream into the formation.

8. The method of claim 5, wherein the well bores in the lower portion of the formation are enlarged prior to injection of the thermal vapor stream.

9. The method of claim 5, wherein the crude oil is recovered until gassing occurs;

ceasing production of the crude oil for a time sufficient to allow the gas cap to reform; and continuing to recover the crude oil from the formation.

10. A method for recovering viscous hydrocarbon crude oil having an API gravity of 21° or heavier from the Cherokee sandstones of Missouri which consists essentially of the steps of:

drilling a well bore to said formation and extending the well bore through the formation;

completing the well bore with a casing means extending to a lower portion of the formation such that the interior of the casing means communicates with the formation in the lower portion of the formation having viscous minerals, including in said completion a tube extending through the casing and into the lower portion of the formation;

injecting into the formation, at elevated pressure, hot gases containing a non-condensable gas to heat the formation to reduce the viscosity of the crude oil and to create a gas cap of non-condensable gas held within an upper portion of the formation by the casing means to increase formation pressure;

ceasing the injection after the formation is heated to allow the heated crude oil or synthetic fuels, having reduced viscosity, to flow under pressure of the gas cap toward the well bore; and recovering the crude oil from the formation.

* * * * *